United States Patent [19]

McLeod

[11] Patent Number: 4,847,004

[45] Date of Patent: Jul. 11, 1989

[54] AQUEOUS CLEANING SOLUTION CONTAINING CHELATING AGENTS AND SURFACTANTS

[76] Inventor: Harry L. McLeod, 2250 Outlaw Rd., Woodlawn, Tenn. 37191

[21] Appl. No.: 238,984

[22] Filed: Aug. 24, 1988

Related U.S. Application Data

[63] Continuation of Ser. No. 935,049, Nov. 26, 1986, abandoned.

[51] Int. Cl.[4] ..... C11D 1/04; C11D 3/33

[52] U.S. Cl. ..... 252/527; 252/173; 252/174.19; 252/528; 252/531; 252/546; 252/547; 252/550; 252/551; 252/558; 252/DIG. 11; 252/DIG. 14; 134/42

[58] Field of Search ..... 252/89.1, 117, 527, 252/531, 545, 546, 547, 550, 558, DIG. 14, 173, 528; 134/42

[56] References Cited

U.S. PATENT DOCUMENTS 4,028,261 6/1977 Petersen et al. ..... 252/89.1

FOREIGN PATENT DOCUMENTS 1446541 6/1966 France .

*Primary Examiner*—Prince E. Willis

*Attorney, Agent, or Firm*—Stephen T. Belsheim

[57] ABSTRACT

A cleaning composition particularly adapted for the cleaning of hard surfaces, and more particularly for use in car washes for the cleaning and brightening of automotive vehicle surfaces without the use of cleaning implements, such as brushes and buffers. The cleaning composition contains one or more chelating agents including an alkali salt of ethylenediamine tetraacetic acid and one or more surfactants including potassium fluorinated alkyl carboxylate.

24 Claims, No Drawings

AQUEOUS CLEANING SOLUTION CONTAINING CHELATING AGENTS AND SURFACTANTS

This is a continuation of co-pending application Ser. No. 06/935,049 filed on Nov. 26, 1986, abandoned.

BACKGROUND OF THE INVENTION

This invention relates to a cleaning composition, and more particularly to a cleaning composition including a chelating agent and surfactants.

Cleaning compositions particularly adapted for use in the washing or cleaning of hard surfaces, such as are used in car washes, are known. Such cleaning compositions usually include a mixture of surfactants and phosphates, or other builders. Also, in many car wash operations, the automotive vehicle is first subjected to a presoaking step in which solvents are applied to the hard surfaces of the vehicle for loosening or dissolving the dirt, grime, oil, grease or other soils on the vehicle surfaces.

Furthermore, cleaning compositions and detergents which include chelating agents and/or surfactants of various types are well-known in the art, as illustrated in the following U.S. Pat. Nos.:

| | | |
|---|---|---|
| 2,474,412 | Bersworth | Jun. 28, 1949 |
| 3,001,945 | Drew et al | Sep. 26, 1961 |
| 3,738,943 | Kaneko | Jun. 12, 1973 |
| 3,823,094 | Lancz | Jul. 9, 1974 |
| 3,840,481 | Miller | Oct. 8, 1974 |
| 3,948,819 | Wilde | Apr. 6, 1976 |
| 4,048,121 | Chang | Sep. 13, 1977 |
| 4,049,556 | Tujimoto et al | Sep. 20, 1977 |
| 4,065,409 | Flanagan | Dec. 27, 1977 |
| 4,086,178 | Walker | Apr. 25, 1978 |
| 4,087,387 | Willems et al | May 2, 1978 |
| 4,122,043 | Kersnar et al | Oct. 24, 1978 |
| 4,167,488 | Murtaugh | Sep. 11, 1979 |
| 4,174,304 | Flanagan | Nov. 13, 1979 |
| 4,176,176 | Cella et al | Nov. 27, 1979 |
| 4,203,872 | Flanagan | May 20, 1980 |
| 4,217,234 | Krisp et al | Aug. 12, 1980 |
| 4,252,663 | Eriksson | Feb. 24, 1981 |
| 4,264,479 | Flanagan | Apr. 28, 1981 |
| 4,302,348 | Requejo | Nov. 24, 1981 |
| 4,375,421 | Rubin et al | Mar. 1, 1983 |
| 4,397,776 | Ward | Aug. 9, 1983 |
| 4,530,781 | Gipp | Jul. 23, 1985 |
| 4,582,636 | Crossin | Apr. 15, 1986 |

The following of the above U.S. Pat. Nos. disclose detergent compositions including tetrasodium ethylenediamine tetraacetate (tetrasodium EDTA): U.S. Pat. Nos. 2,474,412; 3,001,945; 3,840,481; 4,048,121; 4,122,043; 4,174,304; 4,203,872; 4,252,663; 4,264,479; 4,397,776; 4,530,781.

The following patents disclose use of potassium fluorinated alkyl carboxylate (KFAC) in a detergent composition, U.S. Pat. Nos.: 4,086,178; 4,167,488; 4,302,348.

The above patents disclose the KFAC in the form of FC 128, a product of Minnesota Mining and Manufacturing Company.

The Chang U.S. Pat. No. 4,048,121 discloses a metal cleaning composition including both sodium gluconate and tetrasodium ethylenediamine tetraacetate (tetrasodium EDTA).

The Willems et al U.S. Pat. No. 4,087,387 discloses a foam cleaning composition including sodium gluconate, sodium lauryl sulphate, and betaine.

The Rubin et al U.S. Pat. No. 4,375,421 discloses numerous surfactants, including coco betaine for use in a cleansing composition.

The Crossin U.S. Pat. No. 4,582,636 discloses a detergent composition including coco betaine.

The Kaneko U.S. Pat. No. 3,738,943 and the Lancz U.S. Pat. No. 3,823,094 disclose other types of detergent compositions including phosphate builders, for use in car washes.

The Wilde U.S. Pat. No. 3,948,819 discloses a detergent composition for cleaning aluminum aircraft.

The remaining patents disclose various cleaning compositions including a variety of individual ingredients.

None of the above patents disclose a cleaning composition incorporating both an alkali metal salt of ethylenediamine tetraacetic acid (EDTA) and potassium fluorinated alkyl carboxylate (KFAC).

SUMMARY OF THE INVENTION

The cleaning composition made in accordance with this invention was particularly formulated for use on automotive vehicles in various types of car wash operations. However, this cleaning composition has been found to be useful for cleaning hard surfaces of other articles, as well as for cleaning certain fabrics, such as blue jeans.

The cleaning composition made in accordance with this invention basically incorporates one or more chelating agents, including an alkali salt of ethylenediamine tetraacetic acid, and specifically tetrasodium EDTA, and one or more surfactants, including potassium fluorinated alkyl carboxylate (KFAC). Preferably, the alkali salt of ethylenediamine tetraacetic acid is in the amount of 4–40% by weight of the composition and the KFAC is in the amount of approximately 0.02–2.00% by weight of the composition.

In a preferred form of the composition, one or more other known surfactants are also incorporated in the composition in a solution of water.

The use of the above cleaning composition upon a hard surface, such as the body of an automotive vehicle, not only will clean the surface, but also will cause the surface to shine without the addition of any wax or polish, and without the use of brushes or buffing fabrics.

Furthermore, the cleaning composition made in accordance with this invention will not harm or damage either a painted or waxed surface of an automotive vehicle or any other hard surface to which the composition is applied.

A cleaning composition made in accordance with this invention has also been found quite effective in de-sizing and washing new blue jeans and has also been successfully used as a laundry detergent.

DESCRIPTION OF THE PREFERRED EMBODIMENTS

In accordance with the present invention, a cleaning composition, primarily for use on hard surfaces such as automotive vehicle bodies, has been formulated in which one or more chelating agents, including an alkali salt of ethylenediamine tetraacetic acid (EDTA), is dissolved in water, and then one or more surfactants, including potassium fluorinated alkyl carboxylate (KFAC), is added and mixed with the solution.

In a preferred form of the cleaning composition, the alkali metal salt of ethylenediamine tetraacetic acid (EDTA) is added in the amount of 4–40% by weight of the composition, and the potassium fluorinated alkyl carboxylate (KFAC) is incorporated in the amount of approximately 0.02–2.00% by weight of the composition.

Also in a preferred form of the invention, the specific alkali salt of ethylenediamine tetraacetic acid incorporated in the composition is tetra sodium EDTA. It has been found that other soluble alkali metal salts of EDTA may be utilized, such as the tetra potassium salt or the trisodium salt, with equal effectiveness. However, some salts, such as the tetra potassium salt of EDTA is generally more expensive. It is also possible to incorporate the free acid, that is ethylenediamine tetraacetic acid in the mixture with other compounds including the alkali metal radical, such as the hydroxides of sodium or potassium. However, this combination of ingredients has been found less effective than the preprepared alkali metal salt of EDTA.

Also in a preferred form of the invention, one or more other surfactants than the KFAC is preferably added, such as coco betaine, which is very effective in cutting grease, and also sodium lauryl sulphate which is added for its foaming action.

Other surfactants may be used, such as lauryl amine oxide, which is a foam stabilizer.

Some surfactants are added to provide additional synergistic effect in lowering the surface tension of the liquid composition and for increasing its cleaning power.

Although there are various types of fluorinated alkyl carboxylate surfactants, it has been found that the anionic fluorinated surfactant compounds, specifically KFAC, are the most effective. Although the nonionic compound has been used moderately successfully, the cationic compound of the fluorinated surfactant is ineffective. The KFAC compounds of Minnesota Mining and Manufacturing Co. (3M), FC-129, and of DuPont have been used in experiments of cleaning compositions made in accordance with this invention. The FC-129, which is packaged in an isopropyl alcohol medium, has proved very effective.

In the conduct of experiments to determine an effective cleaning composition, the following formulations were used:

| | Compositions | Percentage of Composition by Weight |
|---|---|---|
| (A) | Tetrasodium Ethylenediamine Tetra Acetate (Na4EDTA) | 20.0% |
| | Potassium fluorinated alkyl carboxylate (KFAC) (3M's FC-129) | 0.1% |
| | Water | 79.9% |
| | Total | 100.0% |
| (B) | Na4 EDTA | 20.0% |
| | KFAC (3M's FC-129) | 0.1% |
| | Coco Betaine | 2.5% |
| | Sodium Lauryl Sulphate | 2.5% |
| | Water | 74.9% |
| | Total | 100.0% |
| (C) | Na4EDTA | 40.0% |
| | KFAC (Dupont's Zonyl FSK) | 0.1% |
| | Coco Betaine | 1.5% |
| | Sodium Lauryl Sulphate | 1.5% |
| | Coco Amphopropionate (Miranol Chemical Co. C-2M-SF) | 3.0 |
| | Water | 53.9% |
| | Total | 100.0% |
| (D) | Sodium Citrate | 20.0% |
| | KFAC | 0.1% |
| | Water | 79.9% |
| | Total | 100.0% |
| (E) | Na4EDTA | 5.0% |
| | Tetra Potassium Pyrophosphate | 2.5% |
| | Sodium Metasilicate (anhydrous) | 7.5% |
| | Trisodium Phosphate | 5.0% |
| | Sodium Lauryl Sulphate | 2.2% |
| | Coco Betaine | 2.0% |
| | KFAC (3M's FC-129) | 0.1% |
| | Coco Amphopropionate | 1.5% |
| | Water | 74.2% |
| | Total | 100.0% |
| (F) | KFAC (3M's FC-129) | 1.5% |
| | Water | 98.5% |
| | Total | 100.0% |
| (G) | Na4EDTA | 25.0% |
| | Water | 75.0% |
| | Total | 100.0% |
| (H) | Coco Betaine | 2.5% |
| | Sodium Lauryl Sulphate | 2.5% |
| | Water | 95.0% |
| | Total | 100.0% |
| (I) | Na4EDTA | 45.0% |
| | KFAC (3M's FC-129) | 0.2% |
| | Coco Betaine | 2.5% |
| | Sodium Lauryl Sulphate | 2.5% |
| | Water | 49.8% |
| | Total | 100.0% |
| (This mixture separated into two layers and could not be coupled with sodium xylene sulfonate.) | | |
| (J) | Na4EDTA | 18.0% |
| | Sodium Gluconate | 2.0% |
| | Sodium Lauryl Sulphate | 2.5% |
| | Coco Betaine | 2.5% |
| | KFAC (3M's FC-129) | 0.1% |
| | Lauryl Amine Oxide | 0.2% |
| | Water | 74.7% |
| | Total | 100.0% |

TEST RESULTS

| COMPOSITION | TYPE CAR WASHING Self-Service | Tunnel | Brush-less | REFLECTANCE Before/After | | OBSERVATIONS |
|---|---|---|---|---|---|---|
| F | X | | | 65 | 80 | Much road grime remained |
| G | X | | | 75 | 80 | Much road grime remained |
| H | X | | | 85 | 90 | Much road grime remained |
| A | X | | | 69 | 85 | Fair |
| B | X | | | 85 | 93 | Good |
| D | X | | | 73 | 70 | Dirty |
| C | X | | | 80 | 90 | 10% road grime remained, streaked |
| J | X | | | 75 | 90 | Good |

-continued

| COMPOSITION | TYPE CAR WASHING Self-Service | Tunnel | Brush-less | REFLECTANCE Before/After | | OBSERVATIONS |
|---|---|---|---|---|---|---|
| J | X | | | 55 | 87 | 10% road grime remained |
| J | X | | | 73 | 95 | Good |
| J | | X | | 45 | 93 | Clean |
| J | | | X | 83 | 92 | Clean |
| E | X | | | 50 | 92 | Clean |
| E | | X | | 73 | 94 | Clean (Excellent) |
| E | | | X | 82 | 92 | Clean |
| *Custom Car Wash | X | | | 87 | 91 | Streaked when dry and rubbed |

*(Spartan Chemical)

In the above tests, the self-service car wash is the type in which the automobile or automotive vehicle is driven into the washing station, and the operator gets out of his vehicle, obtains a cleaning wand through which the solution or composition is discharged, and sprays his car with the wand manually.

The tunnel-type car wash is an automatic type in which the vehicle is conveyed through a car wash apparatus incorporating rotary brushes, sprays and/or fabric sweeps.

The brushless type car wash is one in which no brushes or fabric wipers are incorporated, but only sprays are utilized to clean the body surfaces of the car.

The reflectance results were obtained by uniformly applying a known reflectance apparatus to the surface before and after the surface was washed with the designated composition. "Before" reflectance values which were lower than others indicate that the car was initially dirtier than other cars having a higher reflectance value.

The reflectance testing apparatus used in all the above tests were a model 5072 gloss meter manufactured by Eriekson GMBH & Co., D 5870 Herrer-Sundwig, West Germany. The gloss meter is placed directly upon the surface to be tested, the switch turned on, and the reflectance percentage value read from the lighted scale.

The remarks under "OBSERVATIONS" were determined by experienced visual observation. As customary in the car wash industry to determine the effectiveness of a washing operation, the operator's finger is rubbed in a line on the surface of the vehicle before it is washed to make a corresponding visible mark on the surface. After the vehicle is washed, the marked surface is again observed to determine if the mark is still visible, and if so, to what extent. An experienced observer can determine the relative observed value of "dirty", "fair", "good", "clean", "much road grime", "approximately 10% road grime remained", and "approximately 5% road grime remained". When the observation is between 0–10% road grime remained, the rubbed mark is difficult to find on the vehicle surface.

The "Observations" remarks "Much road grime remained" and "Dirty" indicate that substantially more than 10% of road grime remained on the car after washing. The term "Fair" indicated that about 5–10% of the road grime remained.

The "Good" remarks indicated that not more than approximately 5% of the road grime remained, and typically about 95% of the road grime was removed.

It will be noted that the reflectance value of the car body surface cleaned with the composition D was less than the reflectance value before the surface was cleaned.

Although the test results of composition H indicates a relatively high "After" reflectance value of 90, nevertheless, its reflectance value before the cleaning operation was 85, which was relatively high initially.

It will be noted that one of the composition J tests in the "Self-Service" car wash had an "After" reflectance value of less than 90 and approximately 10% of the road grime remained. However, in this test, the reflectance value before washing was extremely low, that is "55". Thus, the reflectance value was substantially improved by 32 points in the test of the composition J in which 10% of the road grime remained. This car was extremely dirty before it was cleaned with the composition J and therefore this result is considered quite acceptable and demonstrates the benefit of composition J.

It will be noted that all of the remaining experiments with composition J and composition E had reflectance values substantially above 90.

The last test result of the Spartan Chemical Custom Car Wash composition, a conventional car cleaning composition, not incorporating the ingredients of this invention, although indicating a high "After" reflectance value of 91, nevertheless, resulted in a streaked surface. Furthermore, it will be noted that the reflectance value was only improved 4 points from an initial relatively high value of 87.

The test results for composition C, although indicating an improvement in the reflectance value of plus 10, nevertheless, did result in a 10% remaining road grime and a streaked surface. In composition C, the tetra sodium EDTA was in an amount at the upper end of the preferred acceptable weight percentage range for the composition made in accordance with this invention. Moreover, because of the 40% amount of tetra sodium EDTA, lesser amounts of coco betaine and sodium lauryl sulphate were used, as well as a substantially lesser amount of water, relatively speaking.

It will be noted that composition I does not appear in the test results for the simple reason that the tetra sodium EDTA was included in an amount of 45% by weight, which is substantially above the operative range of the EDTA salt for a composition made in accordance with this invention. Since the mixture separated into two layers, it could no be utilized to wash a car and therefore could not be tested.

Since composition D and composition F, as well as composition H did not include any EDTA salt, and since composition G did not include any surfactants, test results for these compositions were not satisfactory. Although some cleaning was obtained, nevertheless, the high degree of cleaning resulting from a cleaning composition made in accordance with this invention was not achieved.

All of the formulations for the self-service car wash tests were diluted with 40 parts of water to 1 part of the composition. The composition was applied by a two-gallon garden sprayer. After the cars were throughly sprayed with the compositions, they were rinsed in tap water under 600–800 PSI pressure.

In the tunnel washing tests, the composition was diluted with 10 parts of water to 1 part of composition, and foamed onto the car surface by an air-injected foam sprayer unit. Part of the foam was directly applied to the car and the other portions of the foam were applied to the fabric wiping curtain or the brushes. In the tunnel washing procedure, only 4–6oz. of the diluted mixture was required to clean the automobile. The side brushes were tied back and not used. The rocker panels beneath the automobile doors did have to be cleaned separately by high-pressure soap treatment prior to entering the tunnel. The cleaned car surface was rinsed with low pressure water in the order of 40 PSI, or comparable to an application by a garden hose.

In the brushless car wash applications, the composition was diluted with 20 parts of water to 1 part of composition applied in a very fine spray or mist directly upon the car surfaces. Approximately 2 gal. of mixture per car was all that was needed to clean the cars. In the brushless car wash system, the car was rinsed with high pressure water, that is in the order of 600–800 PSI.

The above tests clearly indicate that compositions E and J were superior to all other compositions. However, compositions A and B were also considered quite effective.

It will be noted that all the successful and acceptable compositions used, that is A, B, E, and J included tetra sodium EDTA, in the range of 4–40% by weight, KFAC in the range of 0.1–0.2%, and water. Some improvement in results was obtained with the addition of other well-known surfactants, particularly coco betaine and sodium lauryl sulphate.

When the composition was built up with certain phosphates and silicates and the EDTA salt was comparably reduced in weight, an excellent cleaning composition, such as E, resulted, which could be used not only upon hard surfaces, but also upon fabrics. Composition E has been successfully used as a laundry detergent and in the de-sizing of new bluejeans.

In other experiments, not recited, any compositions including the alkali metal salts of EDTA in the above prescribed range, and KFAC in lesser amounts down to approximately 0.02% mixed with water have been successfully used and tested.

Other experiments have also been successfully carried out utilizing a composition having the same ingredients as composition J, except that the sodium lauryl sulphate and the coco betaine were replaced by corresponding equal quantities of sodium dodecyl benzene sulfonate and coco amphopropionate. Other compositions simliar to J have been used in which the sodium lauryl sulphate was replaced by an equal amount of sodium lauryl ether sulphate, with successful results. Moreover, other compositions identical to composition J with the exception that the surfactant sodium lauryl sulphate and coco betaine were replaced by correspondingly equal quantities of polyethylene gylcol of primary alcohols and diethanol amine salt of coconut fatty acids, respectively.

Another modification of the J composition is a composition in which the sodium gluconate is removed and the tetra sodium salt of EDTA is used in the amount of 20% by weight.

In the composition E, many other phosphates and silicates might be substituted for the three itemized. For example, tetra sodium pyrophosphate, tetra sodium phosphate, or disodium phosphate could be substituted for the phosphates, while sodium silicate could be used instead of sodium metasilicate.

Other cleaning compositions made in accordance with this invention have been successfully used in which other surfactants have been incorporated with the alkali metal salt of EDTA in the range of 4–40% and the KFAC in the amount of 0.02–0.2% by weight.

One of the main advantages of the use of a cleaning composition, made in accordance with this invention, upon automotive vehicle surfaces is that the road film, grime, dirt, grease, or other soil is removed successfully without the use of cleaning implements, such as brushes or fabrics. Moreover, the vehicle surface not only is clean, but is very bright and reflective, without the addition of any wax or polish. The luster of the painted or waxed surface is substantially restored in a manner not accomplished by other conventional cleaning agents or detergents in the car wash industry.

The cleaning composition made in accordance with this invention may also be effectively employed upon any hard surface material, such as a vinyl, aluminum, steel, brick, paint, or other surfaces of houses, surfaces of boats, glass and many other materials.

The cleaning composition made in accordance with this invention has also been effectively used as a presoak solution for self-service car washes.

What is claimed is:

1. A cleaning composition consisting essentially of (a) an alkali metal salt of ethylenediamine tetraacetic acid in the amount of between greater than about 10 percent and about 40 percent by weight, (b) potassium fluorinated alkyl carboxylate in the amount of between about 0.02 percent and about 2.00 percent by weight, and (c) the balance being water.

2. The cleaning composition according to claim 1 further comprising coco betaine in the amount of between about 1.5 percent and about 2.5 percent by weight.

3. The cleaning composition according to claim 1 further comprising sodium lauryl sulphate in the amount of between about 1.5 percent and about 2.5 percent by weight.

4. The cleaning composition according to claim 3 further comprising coco amphopropionate in the amount of between about 1.5 percent and about 3.0 percent by weight.

5. The cleaning composition according to claim 3 further comprising lauryl amine oxide in the amount of approximately 0.2% by weight.

6. The cleaning composition according to claim 1 in which said alkali metal salt of ethylenediamine tetraacetic acid consists of tetrasodium ethylenediamine tetra acetate.

7. The cleaning composition according to claim 6 further comprising a detergent builder selected from the group consisting of alkali metal phosphates and silicates.

8. The cleaning composition according to claim 7 in which said detergent builder consists of tetra potassium pyrophosphate in the amount of approximately 2.5% by weight, sodium metasilicate in the amount of 7.5% by weight, and trisodium phosphate in the amount of 5.0% by weight.

9. The cleaning composition according to claim 8 further including sodium lauryl sulphate in the amount of 2.2% by weight, and coco betaine in the amount of 2.0% by weight.

10. The cleaning composition according to claim 9 in which said potassium fluorinated alkyl carboxylate is in the amount of 0.1% by weight.

11. The cleaning composition according to claim 10 further comprising coco amphopropionate in the amount of about 1.5% by weight.

12. The cleaning composition according to claim 6 in which said tetrasodium ethylenediamine tetra acetate is in the amount of approximately 18% by weight, and the composition further comprising sodium gluconate in the amount of approximately 2% by weight.

13. The cleaning composition according to claim 12 further includes sodium lauryl ether sulphate in the amount of between about 1.5 percent and about 2.5 percent by weight, and coco betaine in the amount of between about 1.5 percent and about 2.5 percent by weight.

14. The cleaning composition of claim 12 further including sodium dodecyl benzene sulfonate in an amount between about 1.5 percent and about 2.5 percent by weight, and coco amphopropionate in an amount between about 1.5 percent and about 2.5 percent by weight.

15. The cleaning composition according to claim 6 in which said tetrasodium ethylenediamine tetra acetate is in the amount of approximately 20% by weight.

16. A cleaning composition comprising:

an alkali metal salt of ethylendiamine tetraacetic acid in amount of about 18 weight percent;

sodium gluconate in an amount of about 2 weight percent;

potassium fluorinated alkyl carboxylate in an amount of about 0.1 percent by weight;

sodium lauryl sulfate in an amount of about 2.5 weight percent;

coco betaine in an amount of about 2.5 weight percent; lauryl amine oxide in an amount of about 0.2 weight percent, and;

the balance being water.

17. The cleaning composition according to claim 16 in which said sodium lauryl sulphate is in the amount of approximately 2.5% by weight and said coco betaine is in the amount of approximately 2.5% by weight.

18. The cleaning composition according to claim 17 in which said potassium fluorinated alkyl carboxylate is in the amount of approximately 0.1% by weight.

19. The cleaning composition according to claim 18 in which said alkali metal salt of ethylenediamine tetraacetic acid is tetrasodium ethylenediamine tetra acetate.

20. A process for removing dirt and the like from a surface comprising the steps of:

applying to the surface a solution comprising between about 10 parts and about 40 parts of water and 1 part of a cleaning composition comprising between about 4 weight percent and about 40 weight percent of an alkali metal salt of ethylenediamine tetraacetic acid, between about 0.02 weight percent and about 2.00 weight percent of potassium fluorinated alkyl carboxylate, and the balance water; and rinsing the solution from the surface with water.

21. The process of claim 20 wherein said cleaning composition further includes coco betaine in an amount of between about 1.5 weight percent and about 2.5 weight percent.

22. The process of claim 20 wherein said cleaning composition further includes sodium lauryl sulphate in an amount of between about 1.5 weight percent and about 2.5 weight percent.

23. The process of claim 22 wherein said cleaning composition further includes coco amphopropionate in an amount between about 1.5 weight percent and about 3.0 weight percent.

24. The process of claim 20 wherein said alkali metal salt of ethylenediamine tetra acetate is tetrasodium ethylenediamine tetra acetate.

* * * * *